US007802518B2

(12) United States Patent
Schwantes et al.

(10) Patent No.: US 7,802,518 B2
(45) **Date of Patent: *Sep. 28, 2010**

(54) FUZE MOUNTING ASSEMBLIES FOR PENETRATOR WEAPONS

(75) Inventors: Stanley N. Schwantes, Golden Valley, MN (US); Bradley M. Biggs, Corona, AZ (US); Michael A. Johnson, Chaska, MN (US)

(73) Assignee: Alliant Techsystems Inc., Edina, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/434,839

(22) Filed: May 4, 2009
(Under 37 CFR 1.47)

(65) Prior Publication Data

US 2009/0211481 A1 Aug. 27, 2009

Related U.S. Application Data

(62) Division of application No. 11/613,441, filed on Dec. 20, 2006, now Pat. No. 7,549,374.

(51) Int. Cl.
*C06C 7/00* (2006.01)
*F42C 19/06* (2006.01)
*F42C 9/14* (2006.01)

(52) U.S. Cl. ..... 102/275.9; 102/216; 102/265; 102/271; 102/200; 89/6

(58) Field of Classification Search ..... 102/216, 102/265, 266, 271, 396, 473, 499, 200, 501, 102/275.9; 89/6
See application file for complete search history.

(56) References Cited

U.S. PATENT DOCUMENTS

| | | | |
|---|---|---|---|
| 4,622,730 | A | 11/1986 | Steinbock |
| 4,915,028 | A | 4/1990 | Apotheloz |
| 5,325,784 | A | 7/1994 | Bai et al. |
| 5,454,321 | A | 10/1995 | Biggs et al. |
| 5,585,592 | A | 12/1996 | Stearns et al. |
| 5,705,766 | A | 1/1998 | Farace et al. |
| 5,939,662 | A | 8/1999 | Bootes et al. |
| 6,523,477 | B1 | 2/2003 | Brooks et al. |
| 7,197,982 | B2 | 4/2007 | Biggs |
| 7,213,518 | B2 | 5/2007 | Sutcliffe |
| 7,219,589 | B2 | 5/2007 | Gibson et al. |
| 7,357,081 | B2 | 4/2008 | Zinell et al. |
| 2003/0140811 | A1 | 7/2003 | Bone |

OTHER PUBLICATIONS

Glowacki, Brian, Aviation Ordnanceman, Nonresident Training Course, US Navy, Jul. 2001, Chapter 1.

*Primary Examiner*—Michael Carone
*Assistant Examiner*—Michael D David
(74) *Attorney, Agent, or Firm*—TraskBritt

(57) ABSTRACT

A fuze mounting assembly for a penetrating, the fuze mounting assembly includes a fuze well and a fuze. The fuze includes an integral flange for securing to the fuze well.

32 Claims, 3 Drawing Sheets

FUZE MOUNTING ASSEMBLIES FOR PENETRATOR WEAPONS

CROSS-REFERENCE TO RELATED APPLICATIONS

This application is a divisional of U.S. patent application Ser. No. 11/613,441, filed Dec. 20, 2006, now U.S. Pat. No. 7,549,374, issued Jun. 23, 2009, which is related to U.S. patent application Ser. No. 11/613,497, filed Dec. 20, 2006, now U.S. Pat. No. 7,552,682, issued Jun. 30, 2009, and entitled "ACCELEROMETER MOUNTING FOR A PENETRATOR AND METHOD THEREOF," the disclosure of each of which is incorporated by reference herein.

This application is also related to co-pending U.S. patent application Ser. No. 12/434,826, filed May 4, 2009, which is also a divisional of U.S. patent application Ser. No. 11/613,441, filed Dec. 20, 2006, now U.S. Pat. No. 7,549,374, issued Jun. 23, 2009.

FIELD OF INVENTION

The present invention, in several embodiments, relates generally to a fuze mounting for weapons and, more particularly, to a bolted flange fuze mounting for a projectable device used to detect media layers in an effort to locate and destroy sheltered targets penetrated by the projectable device, including a method thereof.

BACKGROUND OF INVENTION

In military operations, targets may be generally classified as either unsheltered targets or sheltered targets. Unsheltered targets may be considered to include targets that are substantially exposed and vulnerable to weapons, including projectable devices fired by artillery directed at such targets. Such projectable devices include, without limitation, artillery shells and rocket-launched projectiles. For example, people, munitions, buildings and other fighting equipment that are openly located on a battle field and substantially exposed to the weapons of an enemy attack may be considered unsheltered targets.

However, many targets including, for example, people, munitions, chemicals, and fighting equipment may be sheltered in order to protect them from an attack by various weapons. Conventionally, a shelter for a target includes a physical barrier placed between the target and the location of origin of an expected enemy weapon in an attempt to frustrate the weapon directed at the target and prevent or mitigate the damage that might otherwise be inflicted by such a weapon. In some cases, targets may be heavily sheltered in an attempt to prevent any damage to a given target. In one example, one or more layers of concrete, rock, soil, or other solid material may be used in an effort to protect a desired target. Each layer may be several feet thick, depending on the level of protection desired. Sometimes these layers are referred to as "hard" layers, the term "hard" indicating a relative amount of resistance that they will impose on an incoming projectable device launched by a weapon system. Generally, a layer is considered to be "hard" when it exhibits a specified level of thickness, when it is formed of a material exhibiting a specified level of hardness or some other material characteristic which significantly impedes penetration of a projectable device, or when the layer exhibits a desired combination of material properties and physical thickness.

In order to penetrate shelters, and particularly a hard layer (or layers) of a given shelter, a weapon system using a projectable device configured with a penetrator system is conventionally used. The general goal of using a penetrator system is to breach the shelter, including any thick layers that may be present, and deliver the weapon projectable device to a desired location (i.e., proximate the intended target) while delaying detonation of the explosive carried by the projectable device until it is at the desired location. Thus, use of a penetrator system enables a more efficient and a more effective infliction of damage to a sheltered target and, sometimes, use of such a system is the only way of inflicting damage to certain sheltered targets.

A penetrator system is part of a weapon system which may include one or more projectable devices in the form of warheads, a penetrator structure (generally referred to as a penetrator) and a sensor (such as an accelerometer) associated with and coupled to the penetrator. The penetrator may be configured to act as a warhead, or it may be a separate component, but generally includes a mass of relatively dense material. In general, the capability of a penetrator to penetrate a given layer of media is proportional to its sectional density, meaning its weight divided by its cross-sectional area taken along a plane substantially transverse to its intended direction of travel. The weapon system may include equipment for guiding the projectable device to a target or, at least to the shelter, since, in many cases, forces associated with impact and penetration of a shelter may result in the removal of such guidance equipment from the penetrator portion of the projectable device. The sensor of a penetrator system is conventionally configured to assist in tracking the location of the penetrator as it penetrates layers of one media type or another after an initial impact of the projectable device and, thus of the penetrator, with the shelter.

Various conventional penetrator systems have been employed with some degree of success. In some conventional penetrator systems, a sensor is used to detect an initial impact with a structure. The system then monitors the amount of time that has elapsed subsequent to the detected impact in an effort to keep track of the location of a penetrator, based on calculated or estimated velocity of the weapon, as the penetrator penetrates a shelter. Such systems are sometimes referred to as time-delay systems.

Other conventional penetrator systems utilize one or more sensors, such as an accelerometer, to measure the deceleration of the penetrator. The system then tracks the distance traveled by the weapon, from the time of the initial impact with a layer of a shelter or structure, in an effort to determine the projectable device's location with the shelter or structure. These systems are generally referred to as penetration depth systems.

Some conventional penetrator systems utilize an accelerometer to detect deceleration of the projectable device responsive to contact with relatively hard and/or thick layers in an effort to help count the layers of media, count voids between the layers of media, or count both media layers and voids so as to determine the projectable device's substantially instantaneous location within a particular structure.

Such conventional penetrator systems provide an output signal for initiating the explosive or other energetic material carried by the projectable device after the penetrator system has determined that the penetrating projectable device has arrived at a desired location within the shelter. Desirably, the initiation of the explosive or other energetic material occurs at a target site, such as within a specified room of a bunker. However, in practice, any of a number of factors may result in the miscalculation of a penetrating projectable device's location within a shelter and, therefore, initiation of the explosive or other energetic material at an undesired location. Such factors may include, for example, variability in the physical or material characteristics of a given layer.

One particular issue faced by conventional penetrator systems includes the ability to detect so-called thin layers. While penetrator systems have been used to detect decelerations that result from contact of the projectable device with a relatively thick or hard layer, such penetrator systems have not been effective in accurately detecting and, thus accounting for, layers that are thin, soft, or some combination thereof, due to the relatively low amount of deceleration experienced by the penetrating projectable device when passing through such thin or soft layers. Some examples of "thin" layers include ceilings and floors in buildings that may be located over a target. Some examples of "soft" layers include layers of sand or other soft soil. Generally, a layer is too thin or too soft to detect when the deceleration of a penetrating weapon, as it passes through such a layer, cannot be discriminated from electrical noise, mechanical noise, or a combination of electrical and mechanical noise experienced by the sensor. Therefore, there is a desire to eliminate, isolate or reduce noise experienced by a penetrator sensor in order to provide better reliability of and indication from the sensor signal, regardless of the characteristics of material layers (thick, thin, hard or soft, including voids) encountered by the projectable device.

In another conventional penetrator system entitled "Method for detection of media layer by a penetrating weapon and related apparatus and systems," by one of the inventors herein, published May 4, 2006 as United States Patent Application number 2006/0090662, the disclosure of which is incorporated by reference herein, provides a method of locating a penetrating-type weapon within a shelter. The method includes projecting the projectable device through a layer of media and detecting a weapon frequency induced by vibration of the projectable device. A harmonic frequency of the weapon frequency is analyzed to determine, for example, whether a deceleration event has occurred. Analysis of the harmonic frequency of the weapon frequency may include determining whether the amplitude of the harmonic frequency meets or exceeds the defined minimum amplitude. In order to improve the robustness and accuracy of determining the amplitude of the harmonic frequency determined, a sensor of a penetrator system, for example, an accelerometer, would benefit from improved vibration, acceleration and deceleration sensing while being less susceptible to noise caused by impact or penetration shock amplification. Therefore, there is a further desire to improve vibration or acceleration sensing by providing a sensor of a penetrator system that is less susceptible to impact or penetration shock amplification.

Accurate detection and recognition of soft, hard, thin or thick layers is desirable in many applications using an installable fuze having a sensor and associated electronics therein. As such, there is a continued desire to improve the penetrator systems used in weapons so as to increase their accuracy in determining their arrival at a desired location by eliminating or reducing noise affecting the sensor's detection capabilities, particularly caused by mechanical amplification experienced at impact and during penetration.

Accordingly, it is desirable to provide a mounting structure that efficiently locks, reliably loads and robustly secures an installable fuze into a fuze well of a penetrator in the form of a projectable device. It would also be of advantage to provide a mounting structure for a fuze that effectively reduces the mechanical amplification caused by high impact and penetration shock.

BRIEF SUMMARY OF THE INVENTION

Accordingly, in one embodiment of the invention a fuze mounting includes one or more fasteners, a fuze well and a fuze coupled to the fuze well by the one or more fasteners.

In embodiments of the invention, a fuze mounting assembly for a penetrating weapon in the form of a projectable device is provided, the assembly including fasteners, a fuze well and a fuze. The fuze includes an integral bolt flange for securing to the fuze well with the fasteners, wherein an amplification of acceleration of less than 3.0 is satisfied when the projectable device is subjected to impact and penetration shock.

In still other embodiments, a projectable device having the fuze is provided.

In yet another embodiment, a penetrating weapon in the form of a projectable device is provided.

In a further embodiment, a method for mounting a fuze is also provided.

Other advantages and features of the invention will become apparent when viewed in light of the detailed description of the various embodiments of the invention when taken in conjunction with the attached drawings and appended claims.

DETAILED DESCRIPTION OF THE INVENTION

In embodiments of the invention, a fuze mounting for a penetrator configured as a projectable device is provided that robustly reduces mechanical amplification caused by impact or penetration shock. Also, the fuze mounting efficiently locks, reliably loads and robustly secures an installable fuze into a fuze well of such a projectable device.

In other embodiments of the invention, a fuze mounting assembly of a penetrating weapon configured as a projectable device that includes fasteners, a fuze well and a fuze is provided. The fuze includes an integral bolt flange for securing to the fuze well with the fasteners, in order to satisfy an amplification of acceleration of less than 3.0, which is satisfied when the projectable device is subjected to impact and penetration shock.

Figure 1:
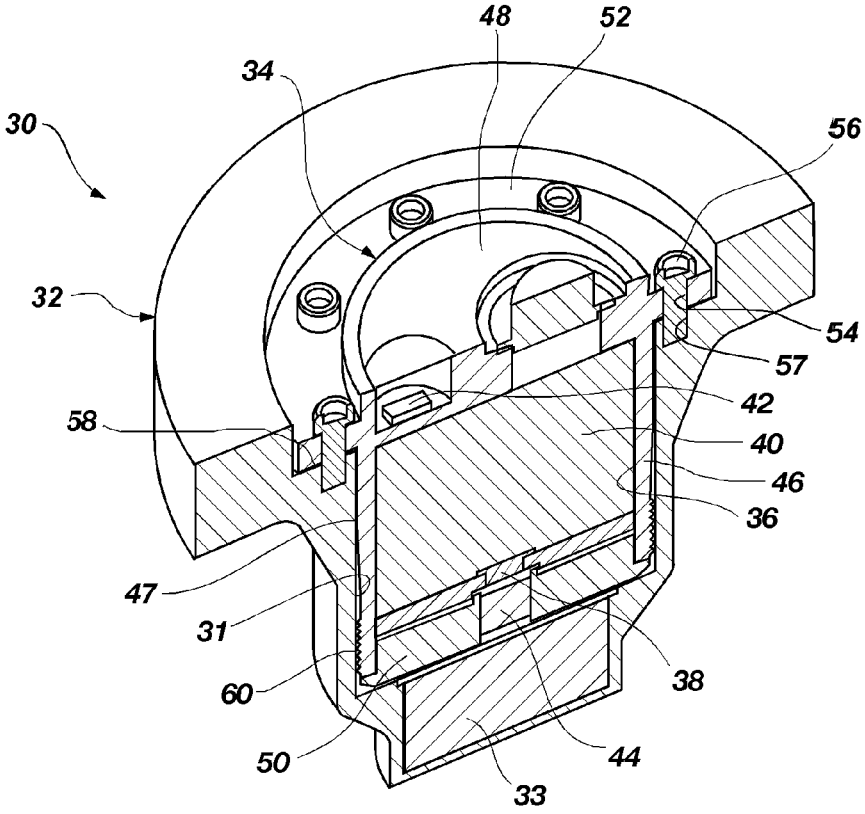
FIG. 1 shows a cross-sectional view of a fuze mounting in accordance with an embodiment of the invention.

FIG. 1 shows a fuze mounting 30 in accordance with an embodiment of the invention. The fuze mounting 30 is suitable for use with any kind of projectable device, including a penetrating warhead. The fuze mounting 30 includes a fuze well 32 having a receiving well 31 configured for receiving a fuze 34 therein. It is noted that the fuze 34 is ideally receivable into the fuze well 32 such that its installation may occur at an opportune time, such as on a battlefield or just prior to arming of a weapon, to provide for the necessary attachment required for detonation while maintaining separate storage of the fuze 34 and a projectable device for safety at other times. In this regard, the fuze 34 may also be removed from the fuze well 32, if required. The fuze well 32 includes, in this embodiment, a booster charge 33 for accelerating the blast of the explosive or other energetic material located within the weapon (not shown).

The fuze 34 includes a fuze housing 36 for receiving the components thereof, such as an exploding foil initiator ("EFI") 38, fuze electronics 40, fuze acceleration sensor 42, and lead charge 44 to name a few, without limitation. Conventionally, the components within the fuze 34 may be securely fastened or potted in accordance with customary practice known to one of ordinary skill in the art. As embodiments of the invention as disclosed and claimed herein are directed to fuze mountings, no further discussion is made regarding the components contained within the fuze 34 and the description that follows will focus primarily upon fuze mounting and the use and characteristics thereof.

The fuze housing 36 includes a wall 46, an aft end 48 and a front end 50. The wall 46 is generally cylindrical, having two ends. While the fuze 34 is generally cylindrical, other shapes, including conic or rectilinear shapes, may be utilized advantageously in order to be consistent with the scope of the invention. The aft end 48, in this embodiment, is integrally formed with the wall 46. However, it is recognized that the aft end 48 may be a separate material piece that is removably connectable to the wall 46 by threads, bolting, or a lock ring (not shown), for example, without limitation. The front end 50, in this embodiment, is secured to the opposite end of the wall 46 by threads (not shown), such that the components of the fuze 34 may be installed therein. The front end 50 may be secured by welding or may also be integral with the wall 46, for example, without limitation. The front end 50 and the aft end 48 may include openings or recesses to facilitate mounting of the components of fuze 34 therein or to facilitate proper operation of the fuze 34 during abnormal or upset conditions, as is understood by those of ordinary skill in the art.

The fuze housing 36 of the fuze 34 further includes an integral bolt flange 52 that extends annularly around an outer surface 47 of the wall 46. The flange 52 in this embodiment is located at the aft end 48 of the wall 46, but it is recognized that the flange 52 may radially extend about the outer surface 47 anywhere along the axial direction of the wall 46. The flange 52 includes mounting holes 54 for receiving a like number of fasteners 56. The fasteners 56 are securable to threaded holes 57 of fuze well 32, symmetrically positioned about an aft closure plate or flange seating portion 58 located on the fuze well 32 of the warhead. The fasteners 56 rigidly secure the flange 52 of the fuze 34 to the flange seating portion 58 of the fuze well 32. In this regard, the fasteners 56 enable the direct coupling of the fuze 34 with the fuze well 32 to eliminate or reduce mechanical amplification that would otherwise be caused by multiple mechanical interfaces, as described above with respect to conventional fuze mounting structures. With sufficient loading by the fasteners 56, the flange 52 and flange seating portion 58 provide a nearly unitary connection that exhibits a substantially reduced susceptibility to mechanical amplification.

Optionally, the fuze types known as HTSF or MEHTF may be modified to incorporate the features of the invention. Specifically, an integral flange may be included with HTSF or MEHTF fuze types, for example, without limitation.

The fasteners 56 in this embodiment comprise threaded bolts having high tensile strength for exhibiting increased stiffness for improved vibration effects caused during impact or penetration shock. However, studs and nuts having similar mechanical properties may also be utilized to advantage. Moreover, it is envisioned that fasteners 56 may be of the type of a stud and jack-nut, or a jack-bolt as described in U.S. Pat. No. RE 33,490 and manufactured by the SUPERBOLT® Inc., of Carnegie, Pa. This type of fastener can be tightened by low torque tools while achieving high fastener tensions ideal for the fuze mounting 30, while providing improved assurance of proper fuze connection loading when in the field.

Optionally, a compression band (not shown) may be included between the outer surface 47 of the wall 46 and the front end 50 of the receiving well 31 of the fuze well 32 in addition to or in replacement of the threaded coupling 60. The compression band may comprise an elastomer, such as a high density neoprene, or may comprise a metal material (such term including alloys), for example, without limitation. The compression band facilitates radial positioning of the fuze 34 within the fuze well 32, while providing shock isolation support in a radial or lateral direction from the interstitial gap that is formed between the receiving well 31 and the outer surface 47 of wall 46 and is located toward the front end 50 of the fuze mounting 30. Also, one or more additional shock absorbing bands (not shown) may be included aft of the optional compression band to further reduce lateral shock in the fuze 34 and components therein.

Figure 2:
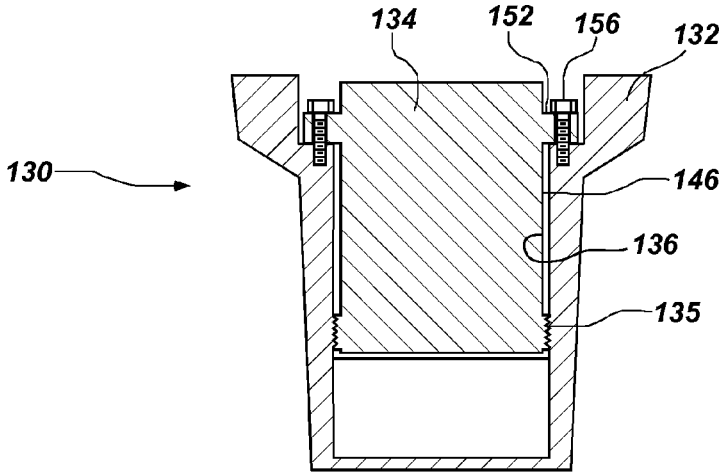
FIG. 2 shows a cross-sectional side view of a fuze mounting in accordance with another embodiment of the invention.

FIG. 2 shows another fuze mounting 130 in accordance with an embodiment of the invention. In this embodiment of the invention, a fuze 134 includes threads 135 upon an outer surface 146 of a fuze housing 136 for cooperatively engaging a fuze well 132. The threads 135, together with bolts 156 and a flange 152, provide additional anchoring between the fuze 134 and the fuze well 132 and add additional support against impact and penetration shock induced mechanical amplification.

Figure 3:
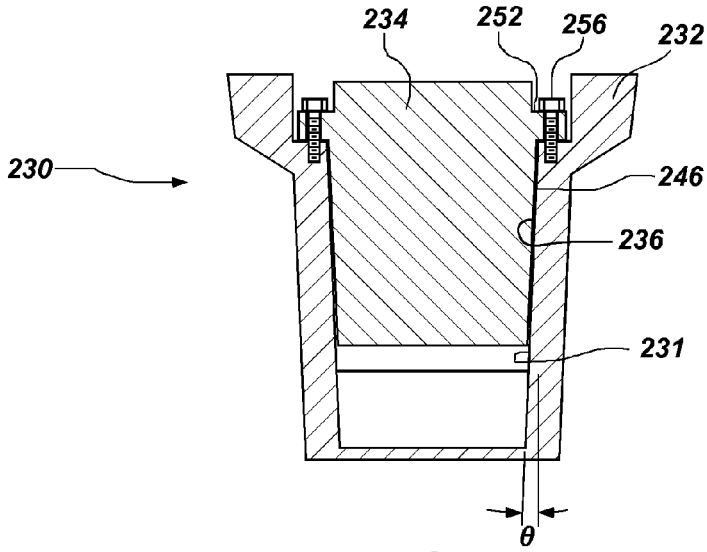
FIG. 3 shows a cross-sectional side view of a fuze mounting in accordance with a further embodiment of the invention.

FIG. 3 shows yet another fuze mounting 230 in accordance with an embodiment of the invention. In this embodiment of the invention, a fuze 234 includes a compression wall 246 upon its fuze housing 236 for cooperatively engaging an inner sloped surface of a compression receiving well 231 of a fuze well 232, enabling a flange 252 of the fuze 234 to be securely fastened to the fuze well 232 by compressive engagement when fastened together by the bolts 256. The compression wall 246 and the inner sloped surface of compression receiving well 231 need not have mating inclinations, but it is anticipated that mating inclinations will provide for better anchoring between the fuze 234 and the fuze well 232, reducing adverse effects caused by mechanical amplification from impact and penetration shock.

Figure 4:
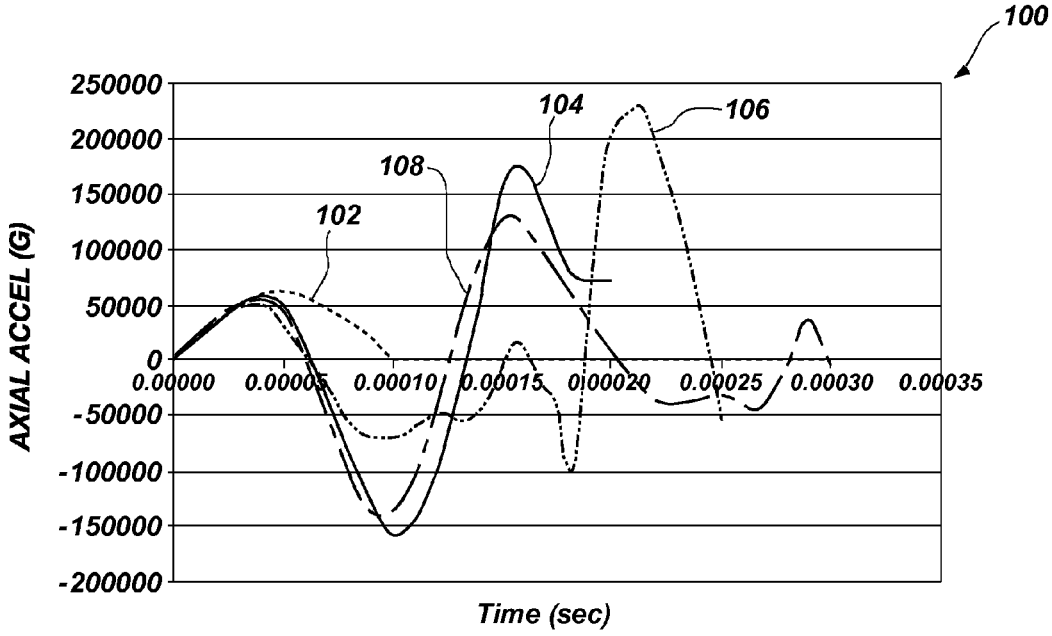
FIG. 4 is a graph of axial acceleration for three different fuze types in response to an input shock.

The performance improvement obtained through use of an embodiment of the invention is shown in FIG. 4 and Table 1. FIG. 4 is a graph 100 of axial acceleration for three different fuze types in response to an input shock 102. The graph 100 includes a vertical axis indicating axial acceleration in Gs in 9.81 meters per second squared, and a horizontal axis indicating elapsed time in seconds. The input shock 102 consisted of a 60,000 G half-sine shock force pulse for 100 microseconds applied in the axial direction for each fuze type. Response 104 is for an HTSF fuze configuration secured to the warhead sandwiched by a fuze locking ring. Response 106 is for an MEHTF fuze configuration secured to the warhead sandwiched by a fuze locking ring. Response 108 is for a fuze mounting in accordance with an embodiment of the invention being secured to the warhead with a bolted flange. Responses 104, 106 and 108 are as observed at the EFI location of the fuze. As is shown in FIG. 4, improved mechanical amplification reduction, in comparison to conventional designs, is achieved by providing a bolted flange fuze mounting design to secure the fuze to the penetrator. The results are tabularized in Table 1, which shows the shock amplification for each fuze type mounting and component packaging.

TABLE 1

Shock amplification of the fuze mounting/packaging.

| Fuze Type | Shock amplification of lead charge (unitless) |
|---|---|
| MEHTF | −1.3/+4.0 |
| HTSF | −2.7/+3.0 |
| Bolted flange with integral aft cover | −3.2/+2.6 |
| Bolted flange with integral front cover | −2.3/+2.2 |

The first set of numbers in each row of the shock amplification of lead charge column of Table 1 represents amplification of deceleration and the second set of numbers represents amplification of acceleration. As depicted, the conventional MEHTF fuze type is subject to 1.3 amplification of deceleration and is subjected to 4.0 amplification of acceleration due to the shock input. The conventional HTSF fuze type is subject to 2.7 amplification of deceleration and is subjected to 3.0 amplification of acceleration due to the shock input. In comparison, the bolted flange connection having an integral aft cover, as described above, is subjected to a lower 2.6 amplification of acceleration due to the shock input, while the bolted flange connection having an integral front cover has a markedly improved 2.3 amplification of deceleration and a vastly improved 2.2 amplification of acceleration. Accordingly, the fuze mounting in accordance with at least one embodiment of the invention exhibits an optimized amplification of acceleration of less than 3.0.

In accordance with at least one embodiment of the invention, the fuze mounting may exhibit higher performance by limiting an amplification of acceleration to less than 2.6, and may exhibit even better performance by limiting an amplification of acceleration to less than 2.2.

In accordance with at least one embodiment of the invention, the fuze mounting exhibits an optimized combined amplification of deceleration and acceleration of less than −2.7 and 3.0, respectively. The fuze mounting may further exhibit higher performance by providing an improved amplification of deceleration and acceleration of less than −3.2 and 2.6, respectively, and may exhibit even better performance by having an amplification of deceleration and acceleration of less than −2.3 and 2.2, respectively. Accordingly, shock survivability of the fuze may be improved by minimizing mechanical amplification of impact and penetration shock.

Figure 5:
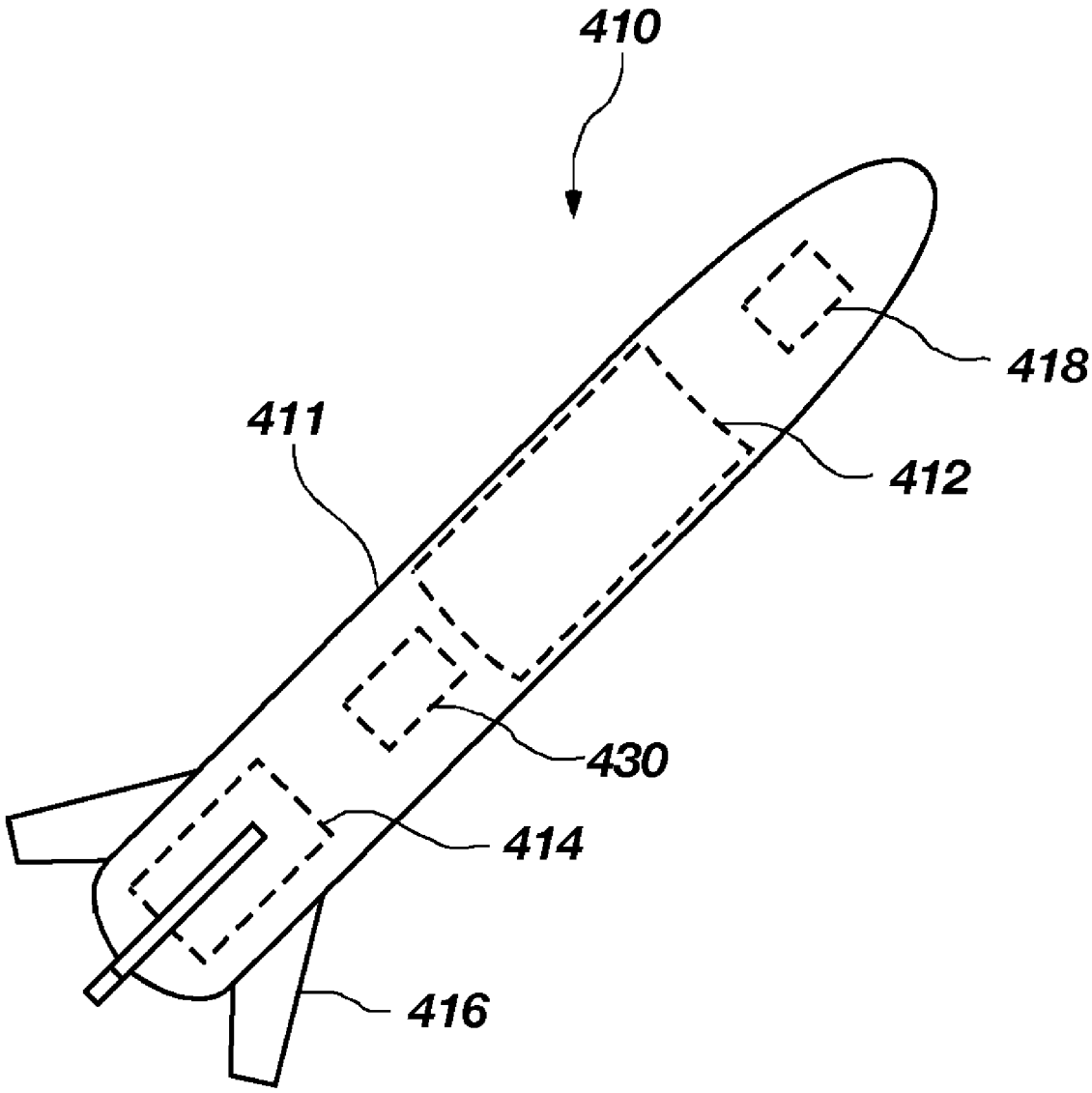
FIG. 5 shows a penetrating weapon in the form of a projectable device having a novel fuze mounting assembly in accordance with an embodiment of the invention.

FIG. 5 shows a penetrating weapon configured as a projectable device 410 having a novel fuze mounting assembly 430 in accordance with the invention. Desirably, the projectable device 410 will comprise a penetrating shell 411 and the novel fuze mounting assembly 430 for igniting an explosive or other energetic material 412 when delivered to an intended target site. The projectable device 410 may optionally include one or more fins 416, a propulsion device 414 and a guidance system 418 for guiding the projectable device 410 to an intended target as would be recognized by a person having skill in the art. However, it is recognized that the projectable device 410 need not necessarily be self-propelled, as it may be shot, launched or dropped toward an intended target.

While particular embodiments of the invention have been shown and described, numerous variations and alternate embodiments will occur to those skilled in the art. Accordingly, it is intended that the invention be limited in terms of the appended claims.

What is claimed is:

1. A fuze mounting assembly of a penetrating weapon comprising:

a fuze well having a receiving well formed therein; and a fuze including a fuze housing having an integral flange formed thereon, a portion of the fuze housing being received in the fuze well and the integral flange being secured to the fuze well, the fuze mounting assembly configured to exhibit an amplification of acceleration of less than 3.0 when subjected to impact and penetration shock responsive to the penetrating weapon contacting a target.

2. The fuze mounting assembly of claim 1, wherein the amplification of acceleration of less than 3.0 comprises an amplification of acceleration of less than 2.6.

3. The fuze mounting assembly of claim 1, wherein the amplification of acceleration of less than 3.0 comprises an amplification of acceleration of less than 2.2.

4. The fuze mounting assembly of claim 1, wherein the fuze mounting assembly is further configured to exhibit an amplification of deceleration of less than −2.7.

5. The fuze mounting assembly of claim 4, wherein the amplification of deceleration of less than −2.7 comprises an amplification of deceleration of less than −3.2 and the amplification of acceleration of less than 3.0 comprises an amplification of acceleration of less than 2.6.

6. The fuze mounting assembly of claim 4, wherein the amplification of deceleration of less than −2.7 comprises an amplification of deceleration of less than −2.3 and the amplification of acceleration of less than 3.0 comprises an amplification of acceleration of less than 2.2.

7. The fuze mounting assembly of claim 1, further comprising a plurality of circumferentially spaced fasteners securing the integral flange to the fuze well.

8. The fuze mounting assembly of claim 7, wherein at least one fastener of the plurality of circumferentially spaced fasteners comprises a nut and stud combination.

9. The fuze mounting assembly of claim 7, wherein at least one fastener of the plurality of circumferentially spaced fasteners comprises a bolt.

10. The fuze mounting assembly of claim 1, wherein the fuze well includes a plurality of threaded holes therein and wherein the integral flange is secured to the fuze well by a plurality of circumferentially spaced fasteners extending at least partially through the plurality of threaded holes.

11. The fuze mounting assembly of claim 1, wherein the fuze housing includes at least one of an exploding foil initiator, fuze electronics, a fuze acceleration sensor, and a lead charge.

12. The fuze mounting assembly of claim 1, wherein the fuze housing includes a cylindrical housing having an aft end and a front end, the front end removably secured to the cylindrical housing.

13. The fuze mounting assembly of claim 1, wherein the fuze housing includes a cylindrical housing having an aft end and a front end, the front end fixed to the cylindrical housing.

14. The fuze mounting assembly of claim 1, wherein the fuze housing includes a cylindrical housing having an aft end and a front end, the front end integral with the cylindrical housing.

15. The fuze mounting assembly of claim 1, wherein the integral flange of the fuze housing includes a plurality of holes therethrough.

16. The fuze mounting assembly of claim 1, wherein the integral flange of the fuze housing mates with a flange seating portion formed in the fuze well.

17. The fuze mounting assembly of claim 1, wherein the fuze housing includes a threaded portion on the exterior thereof.

18. The fuze mounting assembly of claim 1, wherein the fuze well includes a threaded portion in the fuze well.

19. The fuze mounting assembly of claim 1, wherein the fuze well includes a threaded portion in the fuze well and the fuze housing includes a threaded portion on an exterior thereof.

20. The fuze mounting assembly of claim 1, wherein the penetrating weapon comprises a weapon having fins thereon.

21. The fuze mounting assembly of claim 1, wherein the penetrating weapon comprises a projectable device.

22. The fuze mounting assembly of claim 1, wherein the penetrating weapon comprises a penetrating shell.

23. The fuze mounting assembly of claim 1, wherein the penetrating weapon comprises a projectable device that includes one of a self-propelled device, a shot device, a launched device, and a device dropped toward an intended target.

24. A fuze mounting assembly of a penetrating weapon comprising:

a fuze well including a receiving well having a surface on an interior thereof having a threaded portion, a portion of the fuze well having a plurality of threaded holes therein; and a fuze including a fuze housing including an integral flange and a threaded portion on an exterior thereof, a portion of the fuze housing being received in the fuze well, the fuze housing secured to the fuze well by a plurality of circumferentially spaced fasteners extending through the integral flange, the fuze mounting assembly configured to exhibit an amplification of acceleration of less than 3.0 when subjected to impact and penetration shock responsive to the penetrating weapon contacting a target.

25. A fuze mounting assembly of a penetrating weapon comprising:

a fuze well having a receiving well, a portion of the fuze well having a plurality of threaded holes formed therein; and a fuze including a fuze housing having an integral flange, a portion of the fuze housing being received in the receiving well of the fuze well, the fuze housing secured to the fuze well by a plurality of circumferentially spaced fasteners extending through the integral flange, the fuze mounting assembly configured to exhibit an amplification of acceleration of less than 3.0 when subjected to impact and penetration shock responsive to the penetrating weapon contacting a target.

26. The fuze mounting assembly of claim 25, wherein the fuze housing includes a cylindrical housing having an aft end and a front end, the front end fixed to the cylindrical housing.

27. The fuze mounting assembly of claim 25, wherein the fuze housing includes a cylindrical housing having an aft end and a front end, the front end integral with the cylindrical housing.

28. The fuze mounting assembly of claim 25, wherein the integral flange of the fuze housing includes a plurality of holes therethrough.

29. The fuze mounting assembly of claim 25, wherein the integral flange of the fuze housing mates with a flange seating portion formed in the fuze well.

30. The fuze mounting assembly of claim 25, wherein the fuze housing includes a threaded portion on an exterior thereof.

31. The fuze mounting assembly of claim 25, wherein the fuze well includes a threaded portion in the fuze well.

32. The fuze mounting assembly of claim 25, wherein the fuze well includes a threaded portion in the fuze well and the fuze housing includes a threaded portion on an exterior thereof.

* * * * *

UNITED STATES PATENT AND TRADEMARK OFFICE

CERTIFICATE OF CORRECTION

PATENT NO. : 7,802,518 B2
APPLICATION NO. : 12/434839
DATED : September 28, 2010
INVENTOR(S) : Stanley N. Schwantes et al.

It is certified that error appears in the above-identified patent and that said Letters Patent is hereby corrected as shown below:

On the title page:

In ITEM (73) Assignee: change "Edina, MN"
to --Minneapolis, MN--

Signed and Sealed this
Twenty-third Day of August, 2011

David J. Kappos

David J. Kappos
*Director of the United States Patent and Trademark Office*